United States Patent [19]

Fekete, Sr.

[11] Patent Number: 4,949,404

[45] Date of Patent: Aug. 21, 1990

[54] HARDHAT LINER

[76] Inventor: Joseph Fekete, Sr., Virginia Garment Co., Inc., P.O. Box 2029, Richmond, Va. 23216

[21] Appl. No.: 443,600

[22] Filed: Nov. 30, 1989

[51] Int. Cl.[5] ..... A42B 1/06

[52] U.S. Cl. ..... 2/410; 2/190

[58] Field of Search ..... 2/63, 171, 175, 190, 2/195, 198, 201, 272, 410

[56] References Cited

U.S. PATENT DOCUMENTS

| | | | |
|---|---|---|---|
| 1,561,172 | 11/1925 | Koch | 2/190 |
| 1,716,269 | 6/1929 | Hawkins | 2/190 |
| 2,038,398 | 4/1936 | Wengen | 2/201 |
| 3,055,012 | 9/1962 | Aileo | 2/410 |
| 3,157,887 | 11/1964 | Rothstein | 2/201 |
| 3,594,814 | 7/1971 | Schuessler | 2/410 |
| 4,176,409 | 12/1979 | Everitt | 2/201 |
| 4,571,959 | 2/1986 | Chesebro | 2/195 |

FOREIGN PATENT DOCUMENTS

| | | | |
|---|---|---|---|
| 720687 | 12/1954 | United Kingdom | 2/410 |

*Primary Examiner*—Werner H. Schroeder
*Assistant Examiner*—Diana L. Biefeld
*Attorney, Agent, or Firm*—William T. Hough

[57] ABSTRACT

A hardhat liner of two coincident woven tubes embodying a common knitted weave of synthetic fibers, one of the tubes being within the other each having a closed top and sewn together at opposite bottom and top ends thereof, both conforming to a crown of a wearer's head and the sewn-together open bottom being cut and shaped to include a semicircular upwardly-extending forward bottom-edge defining a forward upwardly-extending semicircular cut-out space and both sewn-together open bottom ends sewn-together with elastic thread and embodying a cut and shaped rearward portion having opposite-side portions and an intermediate back portion that are contiguous and congruent portions having a continuing common substantially horizontal bottom peripheral edge aligned and matched with opposite ends of the semicircular forward edge, the semicircular upwardly-extending forward bottom-edges being positioned to be laterally forward of a wearer's ears behind a wearer's eyes and upwardly along a wearer's brow-line when worn and the sewn-together bottom peripheral edge being positioned below a wearer's ears and around a back portion of a wearer's neck when worn, and a method of making.

9 Claims, 2 Drawing Sheets

FIG. 1
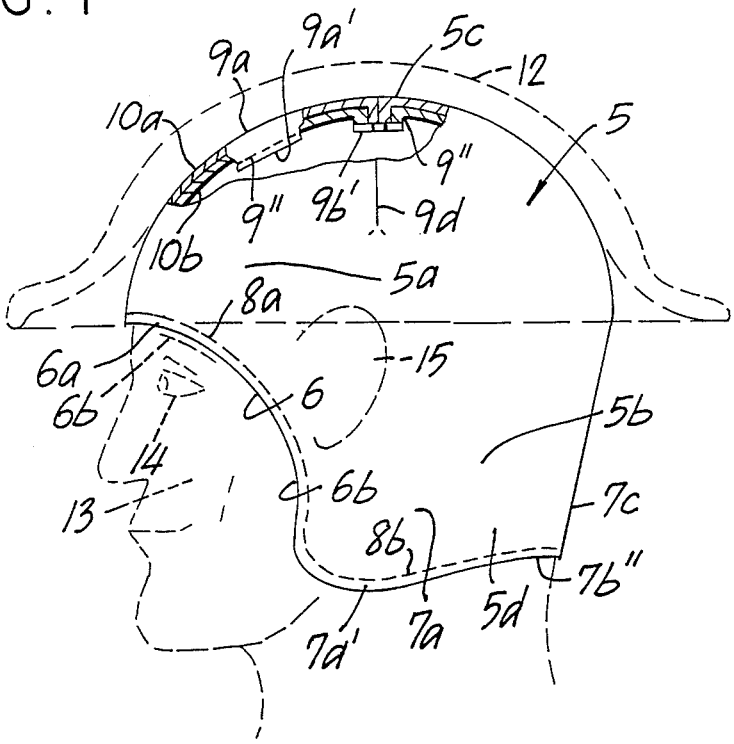
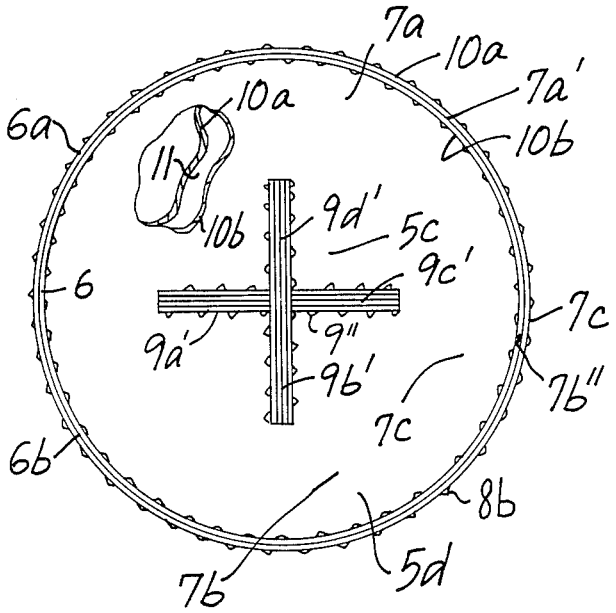
FIG. 3

HARDHAT LINER

This invention relates to a novel hardhat liner for wearing beneath typically construction-work hardhats or sports or other safety hats or helmets.

PRIOR ART

Prior to this invention there have existed helmet-liner or hardhat-liner combinations such as typically illustrated by Heilstedt et al. United States U.S. Pat. No. 2,184,043 and Cox U.S. Pat. 3,205,508 and Aileo U.S. Pat. No. 3,055,012 and Schuessler U.S. Pat. No. 3,594,814. Each of those patents are directed to liner-helmet combinations in which the liner fastens integrally into a helmet. Accordingly, the liners were designed for specific helmets, including expensive elements and gadgets, as well as being utilizable solely with the particular helmets for which each was specifically designed, none corresponding to nor having any bearing on the present invention.

BACKGROUND

Heretofore, there have existed numerous disadvantages and short-comings of prior hardhat liners. Typical of such disadvantages include the large expense or cost involved in the manufacture and purchase of solely specific combination such as shown in the foregoing above-noted patents. Another disadvantage has been the problem of interference with the ability of a worker to hear other workers or warning horns, buzzers, bells or the like — the above-noted U.S. Pat. No. 3,205,508 moreover requiring a specific hearing port 44. Other liners require a large amount of bulk and/or are rigid, interfering with ease of turning or moving-about the head during necessary work movement or looking-around. Another major disadvantage has arisen from the shape of the hat either being subject to accidentally slipping-down over the eyes, or otherwise not properly warmly covering the ears and/or neck. Another disadvantage has been the flappy or loose-fitting nature of the liner, resulting in areas of the sinus and/or ears and/or back and sides of the neck being exposed to cold or freezing air and temperatures resulting in eventual colds and/or muscular cramps. Any one or more of these disadvantages can readily result in major safety hazard on construction job, even to be life-threatening whether from weather-exposure or blocking of good-view visibility or blocking of ready hearing of warning horns, bells and the like.

OBJECTS OF THE INVENTION

Accordingly, objects of the invention include the overcoming and/or avoiding of one or more of the foregoing disadvantages and safety hazards, together with the achieving of additional novel features and advantages thereof.

Another object is to obtain a construction of sufficiently simple design and components as to enable low cost of manufacture and sale, to the benefit of the needy public.

Another object is to obtain a hardhat liner readily adaptable to and utilizable with any of random hardhats or helmets.

Another object is to obtain a hardhat liner that has a plurality of advantages, such as permeable to sound so as not to block the hearing of orders, talk, warning sounds of approaching vehicles or horns or the like and of not obstructing vision nor interfering with the easy turning of the head, while concurrently providing close-fitting warming and retaining body heat of the head and neck, together with being light-weight, inexpensive and utilizable with any of diverse different helmets.

Other objects become apparent from the preceding and following disclosure.

BROAD DESCRIPTION

Broadly the invention may be described as a novel hardhat liner and novel method of making the same.

The novel hardhat liner includes at least two separate single first and second woven liner fabrics. Each and both of woven liner fabrics has corresponding tubular construction having a closed upper portion cut — cutting-away some part thereof to have remaining cut-edges — and sewn to have or be shaped as a dome shaped to conform to a crown of a person's head when worn and having an open lower portion cut and shaped to include a forward upwardly-extending substantially semicircular cut-out space circumscribed by a substantially semicircular upwardly-extending forward edge. Each woven liner fabric additionally includes a rearward portion having opposite-side portions and an intermediate back portion that are contiguous and congruent portions that have a continuing common substantially horizontal bottom peripheral edge. The semicircular forward edge and the horizontal bottom peripheral edge of the first and second woven liner fabrics has aligned and matched with one-another their corresponding domes and and their corresponding open lower portion for matching shapes. In the matched state, the inner and outer tubular fabrics are stitched-together with stitching thread along their corresponding and matched said semicircular forward edges and matched said horizontal bottom peripheral edges. As a result , such critical cut and shaping, when the hardhat liner is worn, the sewn-together semicircular forward edges are normally laterally positioned behind a wearer's eyes in front of a wearer's ears and upwardly along a wearer's brow-line, and the sewn-together horizontal bottom peripheral edges extend rearwardly substantially horizontally below a wearer's ears and around a back portion of a wearer's neck.

In a preferred embodiment, the first and second liner fabrics as cut and folded to the dome-shape, are both sewn-together along the above-noted remaining cut edges of both of the fabrics, to form the above-noted dome shape.

In a preferred embodiment, the hardhat liner's above-noted stitching thread includes elastic thread sewn along said sewn-together semicircular upwardly-extending forward edges and said sewn-together horizontal bottom peripheral edges, such that the sewn-together semicircular upwardly-extending forward edges and horizontal bottom peripheral edges result in the opposite-side portions and a back portion being resiliently tightly held in a close-fit onto the head of a wearer when worn.

In another preferred embodiment, the hardhat liner's first and second woven liner fabrics are of a substantially common weave and composition.

In another preferred embodiment, the hardhat liner of the first and second woven liner fabrics are of a knitted weave.

In another preferred embodiment, the hardhat liner's first and second woven linear fabrics each include at least a major proportion of a synthetic fabric.

In another preferred embodiment, the hardhat liner's first and second woven liner fabrics each include at least a major proportion of a synthetic fabric.

In another preferred embodiment, the hardhat liner's continuing common substantially horizontal bottom peripheral edge includes a minor upward arc extending from each of the opposite-side portions to the intermediate back portion.

In another preferred embodiment, the hardhat liner is produced by the following novel method.

The novel method of making the above-described hardhat liner is by the following steps: (1) weave at least two separate single first and second woven fabrics each having corresponding woven tubular construction having upper and bottom open ends; (2) thereafter cut-away sections of said upper ends of said woven fabrics to leave upper fabric projections having first fabric cut-edges; (3) thereafter for one or more of the first and second woven fabrics, sew-together the first fabric cut-edges to form a hat dome shaped to conform to a crown of a person's head when worn; and (4) cut an arcuate bottom section from the open lower portion of each of the first and second woven fabrics such that for each of the first and second woven fabrics's open bottom portions are shaped to include a remaining forward upwardly-extending substantially semicircular cut-out portion having a substantially semicircular upwardly-extending forward edge and to include opposite spaced-apart lateral portions and and cut a rearward portion of the open lower portion to have the remaining lateral portions and an intermediate back portion, the lateral portions and the rearward back portion being contiguous and congruent portions having a continuing common substantially horizontal bottom peripheral edge; (5) thereafter align the semicircular forward edges and the horizontal bottom peripheral edges of the first and second woven fabrics; and (6) match the first and second woven fabrics with one-another with regard to their corresponding domes and forward and rearward portions and (7) thereafter stitch together the horizontal bottom peripheral edges with stitching thread their corresponding and matched the semicircular forward edges and matched said horizontal bottom peripheral edges, such that when worn the sewn-together semicircular forward edges are normally laterally positioned behind a wearer's eyes in front of a wearer's ears and upwardly along a wearer's brow-line , and such that the sewn-together horizontal bottom peripheral edges extend rearwardly substantially horizontally below a wearer's ears and around a back portion of a wearer's neck.

In a preferred embodiment of the method of claim, in the stitching the employ elastic thread as the stitching thread and stitching along the sewn-together semicircular upwardly-extending forward edges and the sewn-together horizontal bottom peripheral edges, such that the sewn-together semicircular upwardly-extending forward edges and horizontal bottom peripheral edges result in said opposite-side portions and a back portion are resiliently held in a close-fit onto the head of a wearer when worn.

In another preferred embodiment, the weaving step includes predominately (a major proportion) knitting.

In another preferred embodiment, the weaving includes the weaving of at least a major proportion of synthetic yarn threads.

THE FIGURES

FIG. 1 diagrammatically illustrates a preferred embodiment hardhat liner of this invention, as it would appear when mounted or worn on a persons head, the mounted shaped appearance being slightly different from the shaped appearance when not being worn. This FIG. 1 illustrates a side view with partial cut-away portions for improved illustration and description.

FIG. 2 diagrammatically illustrates a top view of the embodiment of FIG. 1, with partial cut-away for purposes of of improved illustration and description.

FIG. 3 diagrammatically illustrates a bottom inside view of the embodiment of FIGS. 1 and 2, with partial cut-away for improved illustration and description.

FIG. 4 diagrammatically illustrates a side view of the embodiments of FIG. 1 as it typically appears when not worn nor mounted on a person's head, having normally a slightly different appearance as to the cut and shape of the sewn fabrics thereof.

DETAILED DESCRIPTION

Figure 2:
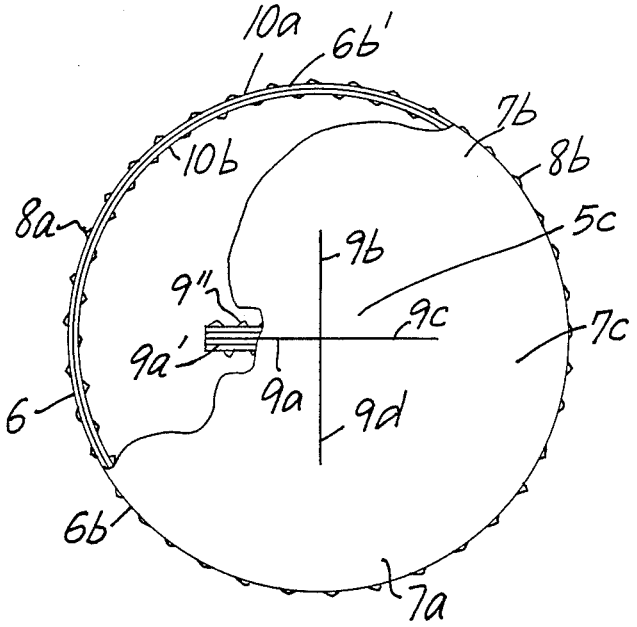

As noted-above in the background and objects, some of the problems have included complexity and cost of manufacture and sale, and interference with hearing orders or talk, or other warning sounds, and interference with clear and easy visibility and comfort, as well as the achieving of insulation and retention of body heat about the head and neck. All of these objects and solutions to problems raised are achieved by virtue of the invention as above broadly described. Additionally however, the double thickness of the tubular materials, results in trapped air space which is a highly effective mechanism and state of enhancing insulation of single fabric considered alone. Moreover, in one preferred embodiment, the presence of the elastic stitching along the peripheral edges of the forward edge and along the horizontal bottom peripheral edge, results in biasing those edges into a close-fitting relationship with the face and neck when worn, avoiding heat-loss through potentially loose-fitting parts and concurrently preventing otherwise loose-fitting parts from interfering with the line-of-sight when turning the head from side to side. Additionally, in another preferred embodiment, the weave is a knitted weave for both of the inner and outer liner-fabrics, such knitted weave inherently providing air-insulation space between the woven fibers of each fabric — adding substantially to the heat-retaining capability and effectiveness of the hardhat liner. This is particularly significant where as in a further preferred embodiment the fabrics of the liner are synthetic such as ORLON (trademark) or NYLON (trademark) or other synthetic fiber, in view of the fact that synthetic fibers of themselves are poor heat-retaining entities, apart from the preferred knitted weave of the present invention. Additionally, the preferred knitted weave has the characteristic of stretchability, as if elastic, such that the novel inventive hardhat of this invention as the knitted fabrics embodiment inherently pulls tightly onto the sides of the face and about the neck when worn, adding to the body heat-retaining function of the present inventive hardhat liner.

In like manner, the above-described cutting and shaping of the forward portion and the rearward portion respectively of the lower ends of the two tubular fabrics as sewn into the hardhat state, results in maximum heat-retention of the body rearward of the eyes but nevertheless protecting the ears by being forward and below the ears, as well as being low on the neck to prevent neck colds or cramps. Likewise, the cut to fit substantially along the brow-line avoids interferring with the line of sight, while concurrently providing important heat-retention along the brow sinus body-structures.

The invention as the embodiment described below in reference to the foregoing figures are not all inclusive of potential embodiments, but represent the more preferred and critical embodiments necessary to accomplish the various objects. Accordingly, while there are various preferred embodiments as above-noted, the preceding figures illustrate the most preferred combination, all figures referring to a common most preferred embodiment thus having common indicia. Once an element is described and numbered for one embodiment, the description is not repeated for other figures except in certain instances to improve clarity of understanding.

With particular reference to the FIG. 1 embodiment, there is disclosed a hardhat liner 5 having a forward cut and shaped portion 5*a* and a rearward portion 5*b* that includes the left lateral portion 7*a* and intermediate back portion 7*c*. The semicircular space formed forwardly is circumscribed by the brow-line forward edge 6*a* and the downwardly arcing left forward edge 6*b* which is continuous with the left bottom horizontal edge 7*a*′ that is continuous with the intermediate back bottom horizontal edge 7*b*″. The brow-line forward upper edge 6*a* as shown extend along a browline 6*b* (shown in phantom) of the wearer, and the left forward edge extends downwardly and rearwardly along the face 13 (shown in phantom) rearward of the left eye 14 (shown in phantom) of the wearer, forwardly of the hidden ear 15 (shown also in phantom) shown in the upper top of the hardhat liner, representing the upper end portion of the double fabric tubes where cut and sewn are collectively represented by indicia 5*c*, the open bottom portions thereof being collectively represented by indicia 5*d*.

In a partial diagrammatic cutaway portion, there is viewable the two thicknesses of inner and outer tubular fabrics, namely outer fabric 10*a* and inner fabric 10*b*. Also shown in that cutaway portion are the forwardly-positioned turned-inwardly cut and shaped and sewn upper-end edges 9*a*′ of the tubular fabrics 10*a* and 10*b* in the sewn state as sewn by thread 9″; also a cross-section of the left-positioned turned-inwardly cut and shaped upper-edges 9*d* of the fabrics 10*a* and 19*b* is shown, as sewn by the thread 9″. Also, in the cutaway, the forward outer-crease 9*a* of inwardly-turned cut-fabrics is shown. Along the circumscribing forward semicircular edges 6*a* and along the horizontal bottom edges 7*a*′ and 7*b*″ is shown the sewn elastic thread 8*a* and 8*b*.

The symbolically illustrated hardhat 12 (shown also in phantom) is illustrated for purposes of placing the hardhat liner 5 into proper perspective as it would appear when worn by a hardhat worker.

FIG. 2 diagrammatically illustrates a top view of the embodiment of FIG. 1, showing the crease-lines 9*a*, 9*b*, 9*c* and 9*d* of the turned-under and sewn edges of the fabric(s). Also, for improved illustration, in a diagrammatic cut-away there are shown a portion of the turned-under and sewn edges 9*a*′, and also the bottom-end's forward and bottom-edge sewn fabrics 10*a* and 10*b* sewn by the elastic thread 8*a* and 8*b* respectively, for the forward edge 6, its component portions 6*b* and 6*b*′, and rearward lateral portions 7*a* and 7*b* and rearward portion 7*c*. Also shown in the cutaway are the turned-under edges 9*a*′ as sewn by the thread 9″.

FIG. 3 illustrates diagrammatically a bottom inside view of the hardhat liner of FIGS. 1 and 2, showing the forward semicircular edge 6 and lateral bottom horizontal edges 7*a*′ and 7*b*″ and the back intermediate bottom edge 7*b*″, and the respective lateral portions 7*a* and 7*b*, the downwardly-extending stitched turned-under upper-end cut and shaped edges 9*a*′, 9*b*′, 9*c*′ and 9*d*′. Also shown in a diagrammatic cutaway are the spaced-apart separate fabrics 10*a* and 10*b* of the body-portion of the hardhat liner 5, having therebetween air-containing space 11 that serves as further insulation holding body heat when the liner is worn beneath the hardhat. Also shown are the downwardly four separately cut edges of each of the fabrics 10*a* and 10*b* as turned-under and sewn as turned-under edges 9*a*′, 9*b*′, 9*c*′, and 9*d*′ with the sewn thread 9″.

Figure 4:
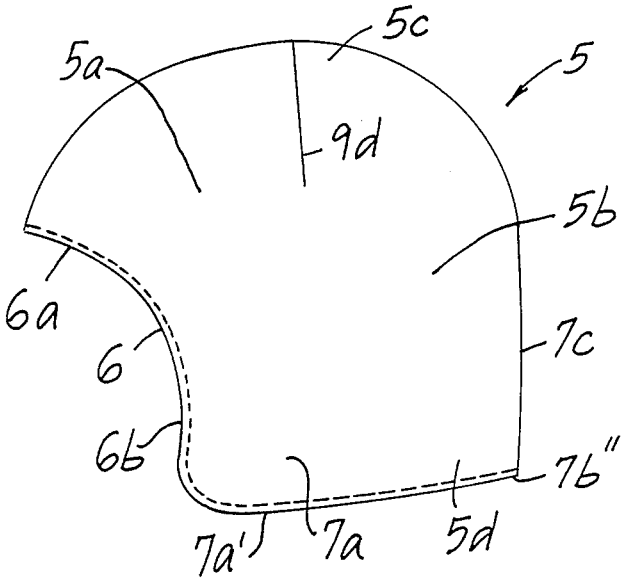

FIG. 4 diagrammatically illustrates a view of the hardhat liner of FIGS. 1, 2 and 3, in side view, as it would typically appear when substantially flattened-out, lying on its side and not being worn, since the fullness of the head of the wearer would not stretch-out the fabrics to the appearance shown in FIG. 1, for example.

Apart from the broad description of the method of this invention, the sole involvements are to use conventional and/or known weaving technology and machinery and equipment to weave the two separate fabric tubes, preferably utilizing knitting weaving technology for above-designated preferred synthetic fibers. While the two separate fabric tubes may be of substantially identical inner and outer cross-sections and/or diameters, preferably tube intended to be the inner tube should be knitted with a slightly smaller cross-section or inner and outer diameters, so as to loosely fit within the larger tube. Obviously the tubes are knitted or otherwise woven to have an inner diameter that corresponds to one or more or an average man's skull or head outer diameter, or the same if designed for children or the like. Accordingly, the present invention of the hardhat liner and the method, does not lie in specific dimensions, but in the simplicity of the foregoing broadly-described steps, of merely inserting one into the other, preferably concurrently cutting the top ends to have the right sectioned shape and likewise preferably concurrently cutting the lower end to the above-described shapes. Likewise the steps of sewing and cutting involve conventional well known technology, requiring no specific description thereof. The simplicity of the method, together with the simplicity of the hat and the low cost of material and method, together with other above-noted achieved objects, sets this method apart from prior art, as a major advance in the art.

It is within the scope of the invention to substitute equivalents and/or to make modifications to any one or more elements of the disclosed invention to the extent that would be obvious to an ordinary artisan in this art.

I claim:

1. A hardhat liner for wearing beneath a hardhat and for retaining warmth of the sinus and ears and neck back and sides while concurrently being fashioned to avoid blocking of good-view visibility and being fashioned to avoid blocking of hearing of warning sounds, comprising at least two separate single first and second liner fabrics each of corresponding tubular construction having a closed upper portion cut and sewn to have a dome shaped to conform to a crown of a person's head when worn, and having an open lower portion cut and shaped to include a forward upwardly-extending substantially semicircular cut-out space circumscribed by a substantially semicircular upwardly-extending forward edge and to include a rearward portion, the rearward portion having opposite-side lateral portions and an intermediate back portion that are contiguous and congruent portions that have a continuing common substantially horizontal bottom peripheral edge, said semicircular forward edge and said horizontal bottom peripheral edge of the first and second woven liner fabrics having aligned and matched with one-another their corresponding said dome and said open lower portion for matching shapes and being stitched-together with stitching thread along their corresponding said dome and said open lower portion for matching shapes and being stitched-together with stitching thread along their corresponding and matched said semicircular forward edges and matched said horizontal bottom peripheral edges, such that when worn said sewn-together semicircular forward edges are normally laterally positioned behind a wearer's eyes in front of a wearer's ears and upwardly along a wearer's browline whereby warmth of the sinus is retained, and such that when worn, said sewn-together horizontal bottom peripheral edges extend rearwardly substantially horizontally below a wearer's ears and around a back portion of a wearer's neck whereby warmth is retained for ears and neck of the wearer and such that when worn said sewn-together horizontal bottom peripheral edges extend rearwardly substantially horizontally below a wearer's ears and around a back portion of a wearer's neck whereby a wearer's side-view is not blocked and whereby the fabric does not exclude warning sounds from ears of the wearer.

2. A hardhat liner for wearing beneath a hardhat and for retaining warmth of the sinus and ears and neck back and sides while concurrently being fashioned to avoid blocking of good-view visibility and being fashioned to avoid blocking of hearing of warning sounds, comprising at least two separate single first and second liner fabrics each of corresponding tubular construction having a closed upper portion cut and sewn to have a dome shaped to conform to a crown of a person's head when worn, and having an open lower portion cut and shaped to include a forward upwardly-extending substantially semicircular cut-out space circumscribed by a substantially semicircular upwardly-extending forward edge and to include a rearward portion, the rearward portion having opposite-side lateral portions and an intermediate back portion that are contiguous and congruent portions that have a continuing common substantially horizontal bottom peripheral edge, said semicircular forward edge and said horizontal bottom peripheral edge of the first and second woven liner fabrics having aligned and matched with one-another their corresponding said dome and said open lower portion for matching shapes and being stitched-together with stitching thread along their corresponding said dome and said open lower portion for matching shapes and being stitched-together with stitching thread along their corresponding and matched said semicircular forward edges and matched said horizontal bottom peripheral edges, such that when worn said sewn-together semicircular forward edges are normally laterally positioned behind a wearer's eyes in front of a wearer's ears and upwardly along a wearer's browline whereby warmth of the sinus is retained, and such that when worn, said sewn-together horizontal bottom peripheral edges extend rearwardly substantially horizontally below a wearer's ears and around a back portion of a wearer's neck whereby warmth is retained for ears and neck of the wearer and such that when worn said sewn-together horizontal bottom peripheral edges extend rearwardly substantially horizontally below a wearer's ears and around a back portion of a wearer's neck whereby a wearer's side-view is not blocked and whereby the fabric does not include warning sounds from ears of the wearer, said stitching thread including elastic thread sewn along said sewn-together semicircular upwardly-extending forward edges and said sewn-together horizontal bottom peripheral edges, such that said sewn-together semicircular upwardly-extending forward edges and horizontal bottom peripheral edges result in said opposite-side and a back portion being resiliently tightly held in a close-fit onto the head of a wearer when worn and such that when worn side-vision is not blocked.

3. The hardhat liner of claim 2, in which said first and second woven liner fabrics are of a substantially common weave and composition.

4. The hardhat liner of claim 3, in which said first and second woven linear fabrics each comprise at least a major proportion of a synthetic fabric.

5. The hardhat liner of claim 3, in which said first and second woven liner fabrics each comprise at least a major proportion of a synthetic fabric.

6. A method of making a hardhat liner for producing a liner for wearing beneath a hardhat retains warmth of the sinus and ears and neck back and side while concurrently thereby is fashioned to avoid blocking of good-view side-visibility and being fashioned to avoid blocking of hearing of warning sounds, comprising in combination: weaving at least two separate single first and second woven fabrics each having corresponding woven tubular construction having upper and bottom open ends; thereafter sufficiently cutting-away sections of said upper ends of said woven fabrics to leave upper fabric projections having first fabric edges to form upper cut-edges; thereafter sufficiently sewing-together at-least said first fabric edges to form a hat dome shaped to conform to a crown of a person's head when worn; and sufficiently cutting-away an arcuate bottom section from said open lower portion of each of said first and second woven fabrics such that for each of said first and second woven fabric said open bottom is shaped to include a remaining forward upwardly-extending forward edge and a rearward portion with the rearward portion having opposite side-portions and an intermediate back portion that are contiguous and congruent portions that have a continuing common substantially horizontal bottom peripheral edge; thereafter aligning said semicircular forward edges and said horizontal bottom peripheral edges of the first and second woven fabrics and matching the first and second woven fabrics with one-another with regard to their corresponding domes and forward and rearward portions; and thereafter sufficiently stitching-together with stitching thread their corresponding and matched said semicircular forward edges and matched said horizontal bottom edges, such that when worn said sewn-together semicircular forward edges are normally laterally positioned behind a wearer's eyes in front of a wearer's ears and upwardly along a wearer's brow-line, and such that said sewn-together horizontal bottom peripheral edges extend rearwardly substantially horizontally below a wearer's ears and around a back portion of a wearer's neck sufficiently that warmth is retained by the sinus and neck of the wearer and such that when worn side-vision is not blocked.

7. The method of claim 6, in which said stitching includes employing as said stitching thread, elastic thread and includes stitching along said pg,24 sewn-together semicircular upwardly-extending forward edges and said sewn-together horizontal bottom peripheral edges, such that said sewn-together semicircular upwardly-extending forward edges and horizontal bottom peripheral edges result in said opposite-side portions and a back portion are resiliently held in a close-fit onto the head of a wearer when worn.

8. The method of claim 7, in which said weaving comprises a major proportion being knitting.

9. The method of claim 8, in which said weaving comprises weaving at least a major proportion of synthetic yarn threads.

* * * * *